United States Patent [19]

Yamazaki et al.

[11] Patent Number: 4,766,578

[45] Date of Patent: Aug. 23, 1988

[54] METHOD OF SETTING TIME IN DIGITAL CLOCK AND SYSTEM THEREFOR

[75] Inventors: Hiroshi Yamazaki; Kazuhiko Shiratori, both of Tokyo, Japan

[73] Assignee: Seikosha Co., Ltd., Tokyo, Japan

[21] Appl. No.: 915,811

[22] Filed: Oct. 6, 1986

[30] Foreign Application Priority Data

Oct. 9, 1985 [JP] Japan ..... 60-225182

[51] Int. Cl.[4] ..... G04C 17/00

[52] U.S. Cl. ..... 368/69; 368/70; 368/185; 368/187

[58] Field of Search ..... 368/69, 70, 185, 187

[56] References Cited

U.S. PATENT DOCUMENTS

| | | | |
|---|---|---|---|
| 3,943,696 | 3/1976 | Portmann et al. | 368/29 |
| 3,986,040 | 10/1976 | Karklys | 307/141 |
| 3,994,124 | 11/1976 | Fujita | 368/70 |
| 4,250,571 | 2/1981 | Ebihara et al. | 368/69 |
| 4,257,116 | 3/1981 | Asano et al. | 368/69 |

*Primary Examiner*—Bernard Roskoski

*Attorney, Agent, or Firm*—Bruce L. Adams; Van C. Wilks

[57] ABSTRACT

A digital timepiece operates in a normal mode and in a set mode for setting time. A keyboard is sequentially actuated for carrying out a switching operation, an entering operation to enter time data to be set, and an executing operation. A counter is connected to the keyboard for producing a first output when the entering operation is not initiated within a relatively short interval after carrying out the switching operation and producing a second output when a relatively long interval lapses after the initiation of the entering operation. A control circuit is connected to the keyboard and to the counter for switching from the normal mode to the set mode in response to the switching operation and for switching from the set mode to the normal mode in response to either of the first and second outputs. A register is connected to the keyboard and operates in the set mode for setting time in response to the executing operation according to the entered time data when the entering operation is completed within the relatively long interval.

12 Claims, 3 Drawing Sheets

METHOD OF SETTING TIME IN DIGITAL CLOCK AND SYSTEM THEREFOR

BACKGROUND OF THE INVENTION

1. Field of the Invention

The present invention relates to a method of setting time in a digital clock through a ten-key and a system for performing the method.

2. Description of the Prior Art

Conventionally, there has been, for example, a digital clock having an alarm function in which time setting is performed through a ten-key as shown in FIG. 3.

In the drawing, a lock switch 8 is normally in a locked state, while, when a time data is entered through a ten-key 9, the lock switch 8 is made set. There are provided mode keys 10 and 11 for selecting the mode to be subject to time setting, that is, for selecting one of the present time and the alarm time to be subject to time setting. A set key 12 admits the data from the ten-key 9 to execute the time setting.

When the time setting is performed in such an arrangement, at first the lock switch 8 is made to be in the set state to enable the time setting. After the designation as to which one of the present time and the alarm time should be subject to the time setting has been performed by the mode-key 10 or 11, time data is entered through the ten-key 9. Upon completion of entry of the time data through the ten-key 9, the time data is admitted through the set-key 12 to perform the time setting.

In the above-mentioned method, it is necessary to provide the lock switch 8 and to select a time-setting mode by operating the lock switch. The method is therefore disadvantageous in high cost, in wide space, as well as in complicated operation for performing the time setting.

SUMMARY OF THE INVENTION

It is therefore an object of the present invention to provide a method of setting time in a digital clock and a system therefor, in which no lock switch is required.

It is another object of the present invention to provide a method of setting time in a digital clock and a system therefor, in which the arrangement and the operation can be made simple.

In order to attain the above objects, according to an aspect of the present invention, the method of performing time setting in a digital clock comprises the steps of: designating a mode to be subject to the time setting by operating a mode key; entering a time data through a ten-key; operating a set key for instructing execution of the time setting; and performing the time setting with respect to the designated mode on the basis of the time data entered by the ten-key so long as both of the condition that the operation of the ten-key has been made within a predetermined lapse of time from the operation of the mode key and the condition that the entry of the series time data by the ten-key and the operation of the set key have been made within a predetermined lapse of time from the operation of the mode key are satisfied.

According to another aspect of the present invention, the system for performing time setting in a digital clock comprises: a mode-key for designating a mode to be subject to the time setting; a ten-key for entering a time data; a set key for instructing execution of the time setting with respect to the designated mode; counter means for counting a period of time from the operation of the mode key; and means responsive to an output of the counter means for performing the time setting with respect to the designated mode on the basis of the time data entered by the ten-key when both of the condition that the operation of the ten-key is made within a predetermined lapse of time from the operation of the mode key and the condition that the series entry of the time data by the ten-key and the operation of the set key are made within a predetermined lapse of time from the operation of the mode key are satisfied.

Other features and advantages of the invention will be apparent from the following description taken in conjunction with the accompanying drawings.

DETAILED DESCRIPTION OF PREFERRED EMBODIMENT

Figure 1:
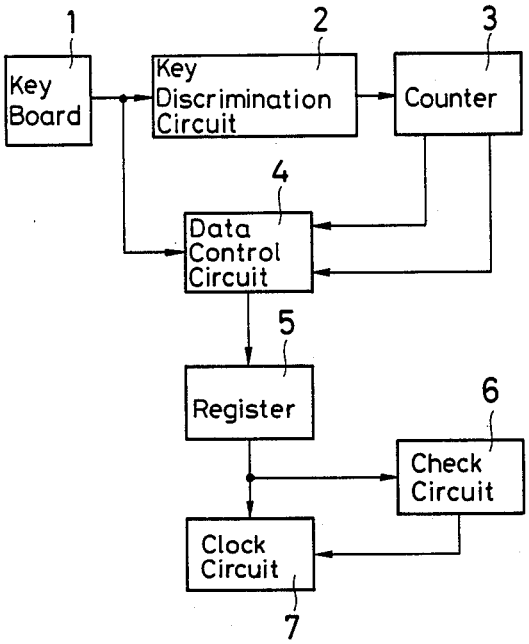
FIG. 1 is a block diagram showing an embodiment of the system for performing time setting according to the present invention.
Figure 3:
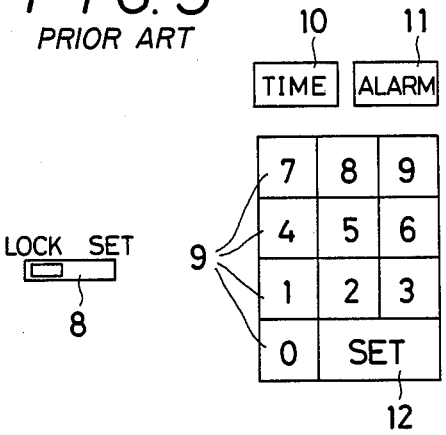
FIG. 3 PRIOR ART
FIG. 3 is an explanatory diagram showing an arrangement for performing time setting in the conventional digital clock.

Referring to FIG. 1, an embodiment of the time setting system for a digital clock will be described hereunder. The system is constituted by: an input key board 1 including a mode key for performing selection as to which one of the present time and the alarm time should be subject to time setting, a ten-key for entering time data, and a set key for transferring the entered time data so as to perform or execute the time setting; a key discrimination circuit 2 for discriminating the key operated among the above-mentioned three kinds of keys; a counter 3 for counting a period of time from a point in time at which the mode key is operated to a point in time in which the ten key is first operated, a period of time required for the entry of the time data by the ten-key, and a period of time required for the operation of the set key; a data control circuit 4 constituted by a CPU; a register 5 for temporarily storing the time data; a check circuit 6 for checking whether the data in the register 5 is valid or not; and a clock circuit 7.

Referring now to the flow-chart of FIGS. 2A and 2B, the operation will be described hereunder. When any one of the keys is operated, judgement is made by the key discrimination circuit 2 as to whether the operated key is the mode key or not (in the step a in FIG. 2A). When the judgement proves that the operated key is the mode key, the register 5 is cleared and sets the selected time setting mode for performing the time setting with respect to the present time or the alarm time, and at the same time, the system state is switched from the locked or normal mode to the time-setting mode (in the step b in FIG. 2A). A flag is set to be "1" and at the same time the content of the counter 3 is reset to be zero (in the step c in FIG. 2A).

When the flag is set to be "1", the counter 3 is incremented one by one every second (in step d in FIG. 2B), and if the first ten-key operation of the successive ten-key operations is not performed or initiated within a four second interval, the system state is brought into the locked or normal mode again and the flag is reset to be "0" to return to the initial in response to the output from the counter 3 (in the step e in FIG. 2B).

Figure 2A:
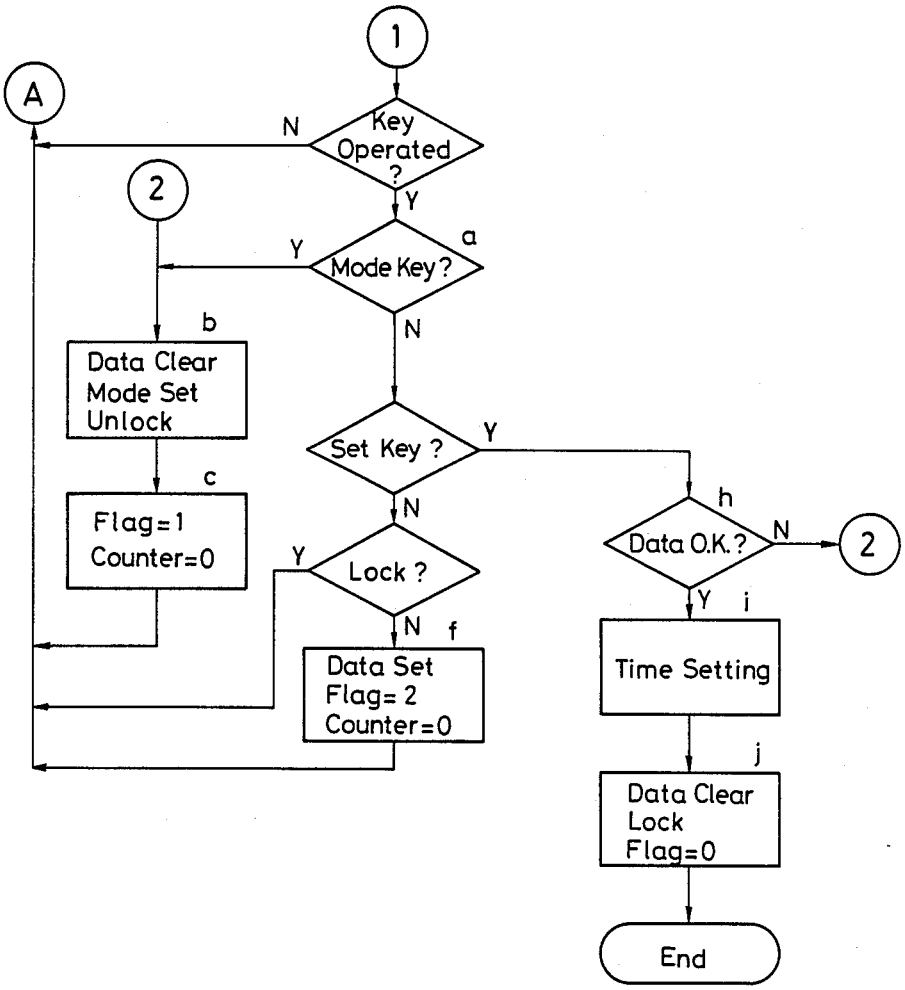
FIGS. 2A and 2B a flow-chart for explaining operations in the system.
Figure 2:
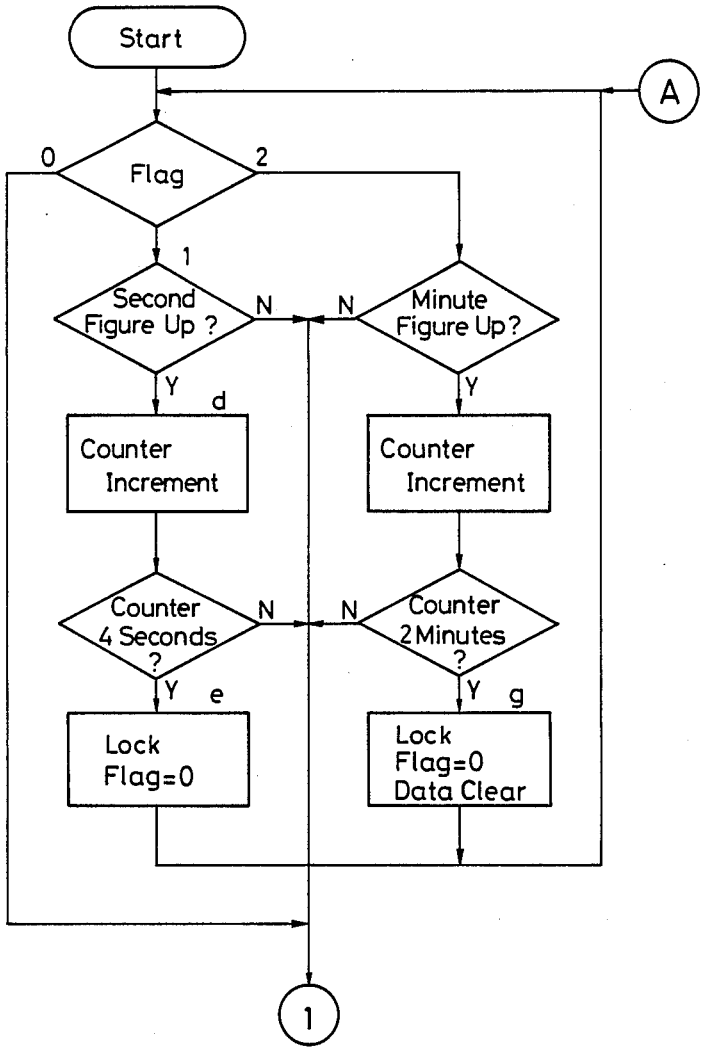

If the first ten-key operation is made before the counter 3 has counted four seconds, of the lapsed time on the other hand, this data is set in the register 5, and at the same time, the flag is set to be "2" and the counter 3 is reset to be "0" (in the step f in FIG. 2A).

When the flag becomes "2", the counter 3 is incremented every minute. When the time data is not set or completed by the successive entering operations of the ten-key before the counter 3 has counted a two-minutes interval, the system state is returned to the locked mode so that the flag is reset to be "0" and the data in the register 5 is cleared (in the step g in FIG. 2A) to come back to the initial step in response to the output from the counter 3.

If the time data is entered by the ten-key and the set-key is operated before the counter 3 has counted two minutes of the lapsed time, it is checked whether the time data is valid or not (in the step h in FIG. 2A). In the cases where the time data represents an invalid numerical value, the system state is returned to the initial step.

When the time data is valid, on the system other hand, the data in the register 5 is preset in the clock circuit 7 to thereby perform the time setting (in the step i in FIG. 2A). The data in the register 5 is cleared and the step is made to be the locked mode, and at the same time, the flag is reset to be "0" to come back to the initial state (in the step j in FIG. 2A).

According to the present invention, the lock switch for selecting the operation mode between the time setting mode and the normal mode becomes unnecessary, so that is is possible to provide a digital clock which is simple in arrangement as well as in operation, which is low in cost, and which is easy in handling.

What is claimed is:

1. A system for performing time setting in a digital timepiece, comprising: a mode-key operable for setting a time set mode; a ten-key operable for entering a series of time data; a set-key operable for instructing execution of the time setting; counter means for generating a first output when the operation of the ten-key for entering a first time data is not performed within a first predetermined lapse time from the operation of the mode-key and for generating a second output after a second predetermined lapse time, which is longer than the first lapse time, from the operation of the ten-key for entering the first time data; control means for returning the time set mode to a normal mode in response to either of the first and second outputs from the counter means; time setting means for setting a time in accordance with the series of time data entered by the ten-key when the first time data from the ten-key is entered within the first lapse time from the operation of the mode-key, then the rest of the time data is entered by the successive operations of the ten-key, and finally the set-key is operated within the second lapse time from the operation of the ten-key for entering the first time data.

2. In a timepiece operative in a normal mode and in a set mode for setting time: input means sequentially operable for carrying out a switching operation, an entering operation to enter time data to be set, and an executing operation; first control means connected to the input means for producing a first output when the entering operation is not initiated within a relatively short time interval after carrying out the switching operation and producing a second output when a relatively long time interval lapses after the initiation of the entering operation; second control means connected to the input means and to the first control means for switching from the normal mode to the set mode in response to the switching operation and for returning from the set mode to the normal mode in response to either of the first and second outputs; and setting means connected to the input means and operative in the set mode for setting time in response to the executing operation according to the entered time data when the entering operation is completed within the relatively long time interval.

3. A timepiece according to claim 2; wherein the input means includes a keyboard having a mode key for carrying out a switching operation, a ten-key for carrying out successive entering operations to enter time data, and a set key for carrying out an executing operation.

4. A timepiece according to claim 3; wherein the inputting means includes discriminating means for discriminating which one of the mode key, ten-key and set key is operated.

5. A timepiece according to claim 2; wherein the first control means includes a counter for counting a predetermined relatively short time interval after the reset thereof in response to the switching operation and producing the first output when the counting is not interrupted by the initiation of the entering operation.

6. A timepiece according to claim 2; wherein the first control means includes a counter for counting a predetermined relatively long time interval after the reset thereof in response to the initiation of the entering operation and producing the second output when the counting is completed.

7. A timepiece according to claim 2; wherein the setting means includes a register for storing therein the entered time data and a clock circuit for receiving therein the stored time data to operate the timepiece in the normal mode based on the received time data.

8. A timepiece according to claim 7; wherein the clock circuit includes means for operating the timepiece in an alarm mode based on an alarm time data.

9. A timepiece according to claim 7; wherein the clock circuit includes means for operating the timepiece in a time mode for indicating a present time based on a correct time data.

10. A timepiece according to claim 7; wherein the second control means includes means for enabling the register only after the switching operation and until either of the first and second outputs occur to store therein the entered time data.

11. A timepiece according to claim 10; wherein the second control means includes means for enabling the register to feed the stored time data to the clock circuit in response to the executing operation.

12. A timepiece according to claim 7; wherein the setting means includes a check circuit for checking the validity of the stored time data.

* * * * *